US005737719A

United States Patent [19]

Terry

[11] Patent Number: 5,737,719

[45] Date of Patent: Apr. 7, 1998

[54] METHOD AND APPARATUS FOR ENHANCEMENT OF TELEPHONIC SPEECH SIGNALS

[75] Inventor: Alvin Mark Terry, Longmont, Colo.

[73] Assignee: U S West, Inc., Englewood, Colo.

[21] Appl. No.: 574,527

[22] Filed: Dec. 19, 1995

[51] Int. Cl.[6] ..... G10L 3/02

[52] U.S. Cl. ..... 704/224; 704/209; 381/68.2

[58] Field of Search ..... 395/2.33, 2.09, 395/2.16, 2.14, 2.18, 2.12, 2.13, 2.34; 381/68, 68.1, 68.2, 68.3, 68.4; 704/224, 200, 207, 205, 209, 203, 204, 225

[56] References Cited

U.S. PATENT DOCUMENTS

| | | | |
|---|---|---|---|
| 4,099,035 | 7/1978 | Yanick | 381/68.2 |
| 4,454,609 | 6/1984 | Kates | 381/68 |
| 4,593,696 | 6/1986 | Hochmair et al. | 381/68 |
| 4,833,716 | 5/1989 | Cote, Jr. | 395/2.85 |
| 4,887,299 | 12/1989 | Cummins et al. | 381/68.4 |
| 5,027,410 | 6/1991 | Williamson et al. | 381/68.4 |
| 5,274,711 | 12/1993 | Rutledge et al. | 395/2.34 |
| 5,388,185 | 2/1995 | Terry et al. | 395/2.14 |

OTHER PUBLICATIONS

"Processing the Telephone Speech Signal for the Hearing Impaired", Mark Terry et al. Behavioral Audiology, Ear and Hearing, vol. 13, No. 2, 1993 pp. 70–79.

"Strategies for Enhancing the Consanant to Vowel Intensity Ratio With In the Ear Hearing Aids", David Preves et al. Ear and Hearing, vol. 12, No. 6, pp. 139S–153S.

"Modeling Rapdi Waveform Compression on the Basilar Membrane as Multiple–Bandpass–Nonlinearity Filtering", Julius Goldstein, Hearing Research, 49 (1990) 39–60.

Images of the Twety–First Century. Proceedings of the Annual International Conference of the IEEE Engineering in Medicine and Biology Society;Papagiannis et al., "Real–Time multipricessor speech processing to aid the hearing impaired"; pp. 1508–1509 vol. 5, Nov. 1989.

IEEE Transactions on Biomedical Engineering; Zierhofer et al., A feedback control system for real–time formant estimation. I. Static and Dynamic ana lysis for sinisoidal input signals, pp. 886–891, vol. 40.– II. Analysis of a hyteresis effect and F2 estimat, Sep. 1993.

IEEE Transactions on Biomedical Engineering.; White et al., "Speech recognition in analog multichannel cochlear prostheses:initial experiments in controlling classification"; p. 1002–1010, vol. 37 Oct. 1990.

*Primary Examiner*—Allen R. MacDonald
*Assistant Examiner*—Richemond Dorvil
*Attorney, Agent, or Firm*—Brooks & Kushman

[57] ABSTRACT

A method and apparatus for enhancing the intelligibility of a telephonic speech signal within the available bandwidth and intensity limits of a telephone communication network. The method combines enhancement of both the formant ratio and the consonant/vowel energy ratio to realize a speech signal more intelligible to a hearing impaired user. The invention uses an auditory model of the human ear. A speech signal is put through a filter bank designed to simulate the cochlear filter shapes and filter spacing of a healthy cochlea. The energy output from each of a plurality of filters is computed and used to form an auditory spectrum. The peaks associated with strong first and second formants are identified, and the second formant is enhanced relative to the first formant by attenuating the first formant. Also, consonants in the speech signal are identified as having an energy level below a threshold associated with vowels, but above the threshold associated with silent regions. Consonant regions are amplified. The net effect is to provide more energy in regions of the second formant and the consonants to enhance the intelligibility of the speech signal.

13 Claims, 3 Drawing Sheets

METHOD AND APPARATUS FOR ENHANCEMENT OF TELEPHONIC SPEECH SIGNALS

TECHNICAL FIELD

This invention relates to the processing of telephonic speech signals to enhance their intelligibility to hearing impaired users.

BACKGROUND OF THE INVENTION

The problem addressed by this invention is the difficulty experienced by hearing-impaired individuals in using the telephone. There are several factors that contribute to such difficulty. First, the telephone signal is bandwidth limited in the typical range of 300 to 3,000 Hz. Second, a hearing-impaired telephone user does not have the benefit of visual lip-reading cues. Third, both acoustic and magnetic coupling of a hearing aid to a telephone receiver remains poor. Even though recent legislation in the United States requires new telephones to be "hearing aid compatible," and to provide sufficient leakage to drive the telecoil of the hearing aid, many existing telephones do not meet new standards and many hearing aids are not fitted with telecoils. Fourth, there is an occasional problem of low signal strength or background noise accompanying the speech signal. Amplified handsets are of some value, but the nature of the user's hearing loss may not be adequately overcome by simply amplifying the speech signal.

One approach to enhancing the intelligibility of a telephone speech signal is to adaptively process it to match the hearing impairment profile of the user. In this approach the user's impairment is characterized by a profile across the telephonic bandwidth. Specifically, at each frequency level within the telephonic bandwidth, the hearing characteristics of a particular user may be measured by two parameters. First is a threshold value of (T), which indicates the power level each frequency point must have for the listener to be able to hear that particular frequency. Second is a limit (S) on the listener's dynamic range at each frequency point at which the listener experiences pain or discomfort when the power left at the frequency point is increased.

The T and S values constitute a hearing profile that characterizes an individual listener. These profiles may be commonly grouped or classified to match typical hearing impairment problems. The speech signal is adaptively processed to compensate for the hearing impairment profile of the user. This approach is disclosed in U.S. application Ser. No. 07/767,476, filed Sep. 30, 1991, which is commonly assigned. See also Terry et al., The Telephone Speech Signal for the Hearing-Impaired, *Ear and Hearing,* 1992; 13(2): 70–79.

Processing the speech signal by accentuating the consonant regions relative to the vowels can increase intelligibility without a significant increase in signal level. One approach to consonant enhancement is based on the work of Preves et al. in a time domain processing method. Consonant regions are detected by a relatively low energy in a 10-msec time window. Consonants are identified by having energy below a threshold associated with vowels but above the threshold associated with silent regions. These regions are then amplified, thus increasing the consonant/vowel intensity ratio. See Preves et al., Strategies for Enhancing the Consonant-to-Vowel Intensity Ratio with In-The-Ear Hearing Aids, *Ear and Hearing,* 1991; 12(6): 139S–153S.

Another technique uses a multiple bandpass nonlinearity model of the type proposed by Goldstein. See Goldstein, Modeling Rapid Waveform Compression on the Basilar Membrane as Multiple-Bandpass Nonlinearity Filtering, *Hearing Research,* 1990, 49, 39–60.

DISCLOSURE OF THE INVENTION

An objective of the present invention is to develop a method and related apparatus for enhancing the intelligibility of a telephonic speech signal that covers a broad range of hearing losses. The objective is realized by boosting mainly the consonants and primary cues to vowel identification while minimizing the overall distortion in the temporal envelope of the speech signal.

A feature of the present invention is the identification of features on which to drive a resynthesis of speech by modification of a short-term speech spectrum.

An advantage of the present invention is the lack of a need to customize the speech processing to an individual's hearing loss.

In realizing the aforementioned and other objectives, features and advantages, the present invention employs an auditory model designed to simulate the cochlear filter shapes and filtering spacing of a healthy cochlea. The auditory model is used to resynthesize a speech signal via modification of a short-term speech spectrum. The auditory model includes a filter bank with a plurality of filters distributed over a frequency scale. The energy output from each filter is computed and used to form an auditory spectrum.

Peak picking is used to identify regions where there are strong first and second formants. The second formant is enhanced relative to the first formant by fitting a filter to attenuate the first formant.

Consonants are identified as having energy below a threshold associated with vowels but above the threshold associated with silent regions. The consonant regions are then amplified.

The auditory spectrum is then mapped to a Fourier spectrum. An inverse Fourier transform converts the processed speech back to the time domain, and the processed speech is then normalized to have the same average energy as the unprocessed speech. This has a net effect of providing more energy in regions of second formants and consonants.

This speech signal processing method may be implemented within a telephone network. It does not require that the enhancement be customized to the hearing impairment profile of the user.

The objectives, features and advantages of the present invention are readily apparent from the following detailed description of the best mode for carrying out the invention when taken in connection with the accompanying drawings.

BRIEF DESCRIPTION OF THE DRAWINGS

A more complete appreciation of the invention and the attendant advantages thereof may be readily obtained by reference to the following detailed description when considered with the accompanying drawings in which like reference characters indicate corresponding parts in all the views, wherein.

BEST MODE FOR CARRYING OUT THE INVENTION

Figure 1:
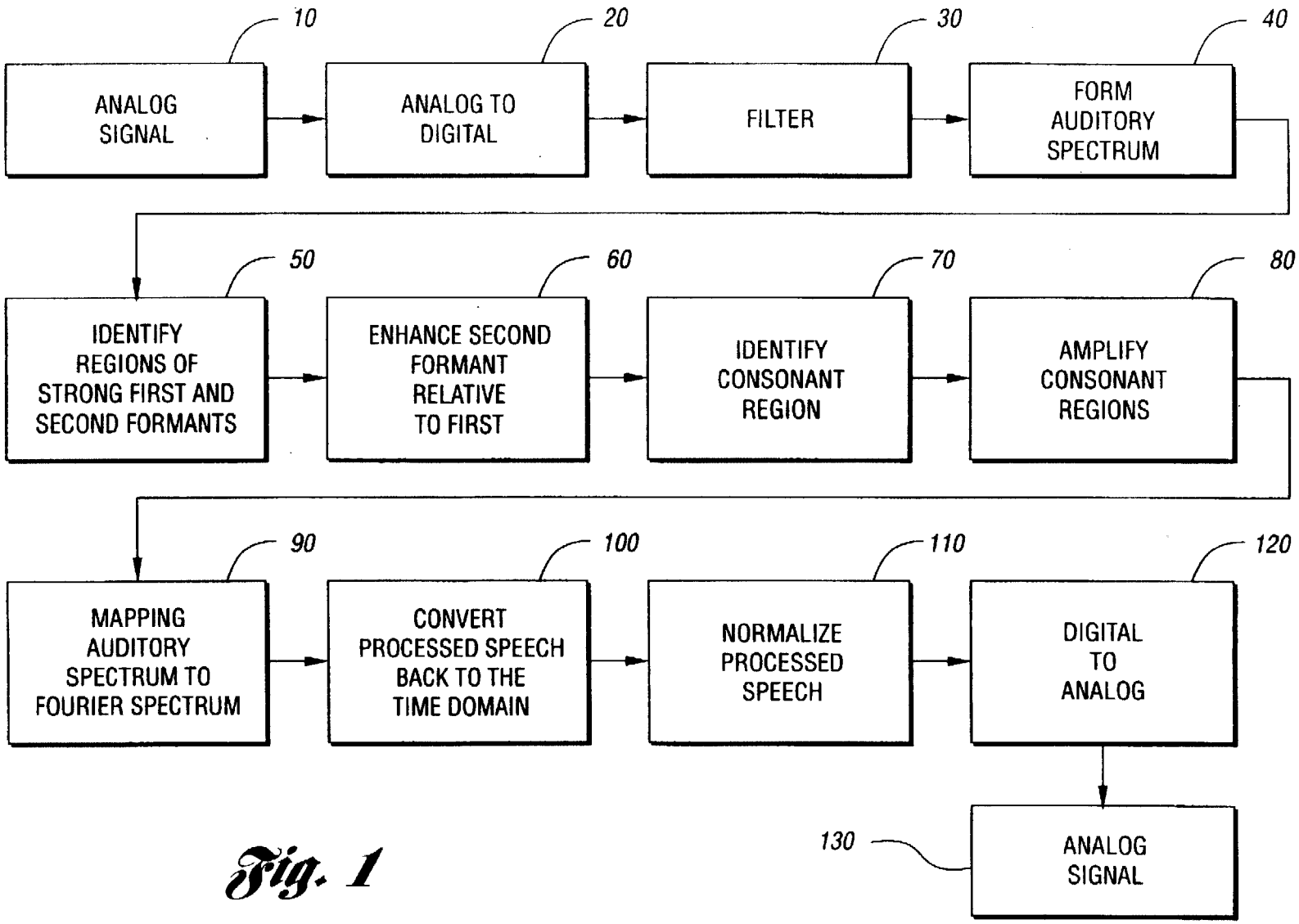
FIG. 1 is a block diagram showing the steps in the speech enhancement process of the present invention.

With reference to FIG. 1 of the drawings, an analog signal representative of a speech signal is generated, in step 10, when a telephone user speaks into an originating telephone. It should be understood that the signal could, of course, be generated by a microphone, audio tape player, oscillator or one of many other sources of analog audio signals.

The analog signal is converted, in step 20, to a digital signal. The digital signal preferably has a 16-bit format to provide necessary precision. The analog-to-digital conversion is performed in a conventional manner by, for example, a commercially available Ariel Digital Signal Processing Board, which uses a DSP-32C chip.

The digitized speech signal is then filtered, in step 30, by a filter bank designed to imitate the cochlear filter shapes and filter spacing of a healthy cochlea, the spiral-shaped portion of the internal ear that contains auditory nerve endings. There are 16 filters distributed according to the Bark frequency scale. The energy output from each filter is computed and used, in step 40, to form an auditory spectrum.

Spectral peaks are known as formants; and peak picking is used, in step 50, to identify regions where there are strong first and second formants. A second formant is enhanced, in step 60, relative to a first by fitting a filter with a 10 to 14 dB/octave, and preferably a 12 dB/octave, rolloff to attenuate the first formant. Consonant are identified, in step 70, as having energy below a threshold associated with vowels but above the threshold associated with silent regions. Consonant regions are detected within a relatively short time window, preferably 10 msec. The consonant regions are then amplified in step 80.

In step 90, the auditory spectrum is mapped to the Fourier spectrum by a mapping from the Bark frequency scale to the linear frequency scale. An inverse Fourier transform converts, in step 100, the processed speech back to the time domain. The processed speech is then normalized, in step 110, to have the same average energy as the unprocessed speech. This has the net effect of providing more energy in regions of the second formant and the consonants. The digital signal is then converted, in step 120, to an analog signal 130 and communicated to the telephone receiver of a hearing impaired user.

Tests were performed to determine the relative effectiveness of the present invention. A recording of the California Consonant Test was made using both male and female speakers. The recording was made in a soundproofed enclosure using a 16-bit digital audio tape with a 16 kHz sampling rate. The tape was then redigitized using a 16-bit analog-to-digital converter and filtered, using a digital brick wall FIR filter, to the telephone band, which extends from 300 Hz to 3000 Hz.

The speech was processed by various enhancement algorithms and stored for later replay. The control condition used was filtered, unenhanced speech. The speech was presented monaurally to the ear each subject normally used while using a telephone. To prevent learning effects, target words for 100 word lists were randomized. Foils of four choices were also randomized.

The subjects viewed, from a soundproofed room, the four choices of a test foil on a computer screen. The computer screen was located outside the room and was viewed through a window. A foil was presented prior to the presentation of a target word through a headphone to create a forced choice condition. Each subject used a mouse to point to their choice on the computer screen.

The computer recorded the word selected, the time required to select the word, the correct choice, and the four foil words. It also recorded the phonemes associated with the target and recorded words. After each test, the computer computed the percent of correct choices and confusion matrices for all words and words separated into final consonant and initial consonant conditions.

Each of the types of signal processing was presented at 70, 80 and 90 dB, which corresponds approximately to the normal output range of a telephone system. If a subject took tests on different days, the control conditions were repeated. Five subjects were tested, and averaged results (percent correct) are shown by a graph in FIG. 2. To compute the graph, all scores were averaged across subjects and presentation levels.

The labels used in the graph represent the following.

TEL=unenhanced speech.

TFSC=frequency-shaped speech.

TCVR=consonant-vowel-ratio enhanced speech.

a TAM=uditory-model-enhanced speech.

N=number of results used in averaging.

As shown, for all subjects, the enhanced speech was superior to the unenhanced speech at all loudness levels.

Figure 3:
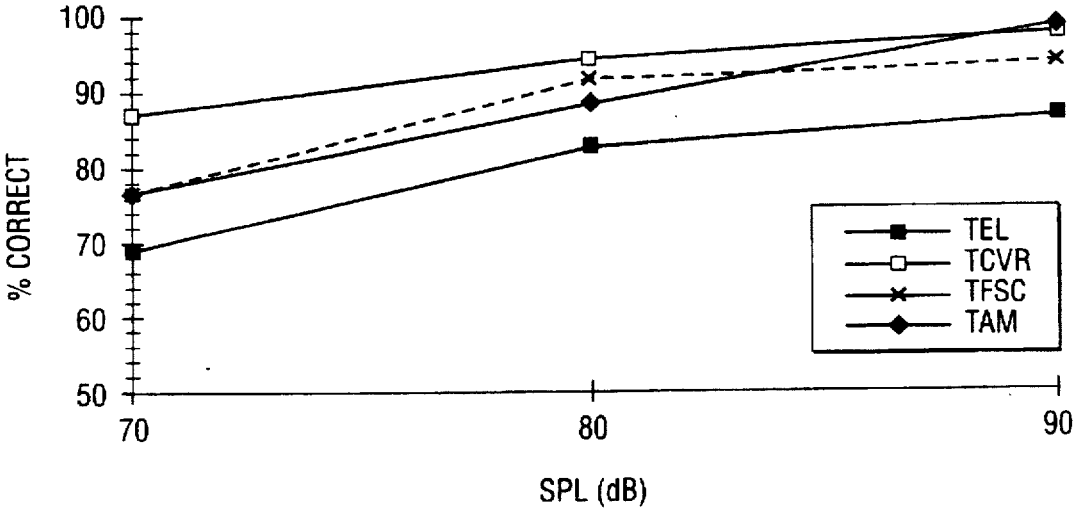
FIG. 3 is an audiogram showing detailed intelligibility test results of a first of two most completely tested subjects listening to unenhanced and enhanced speech.
Figure 4:
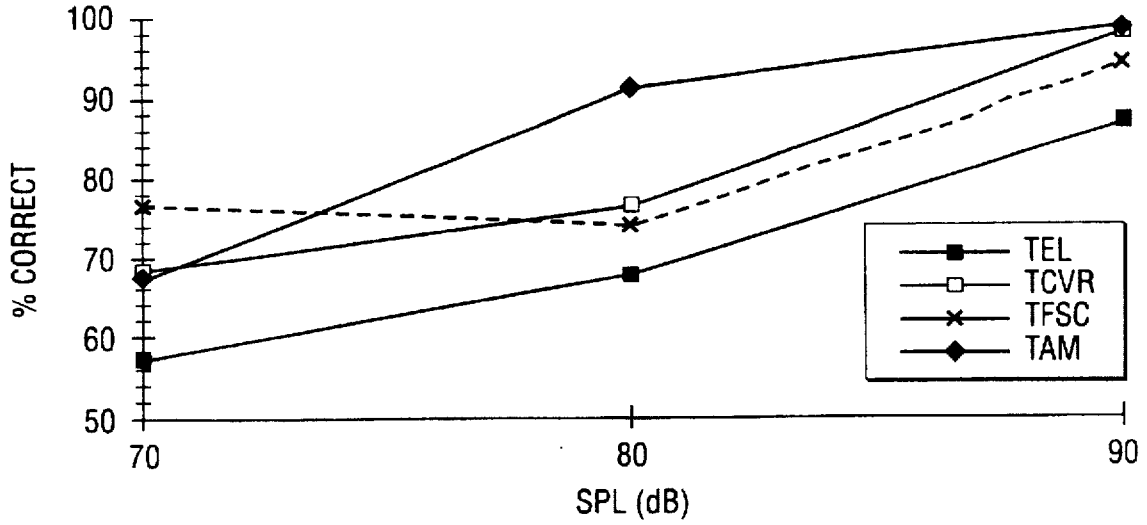
FIG. 4 is an audiogram showing detailed intelligibility test results of the second of the two most completely tested subjects listening to unenhanced and enhanced speech.
Figure 5:
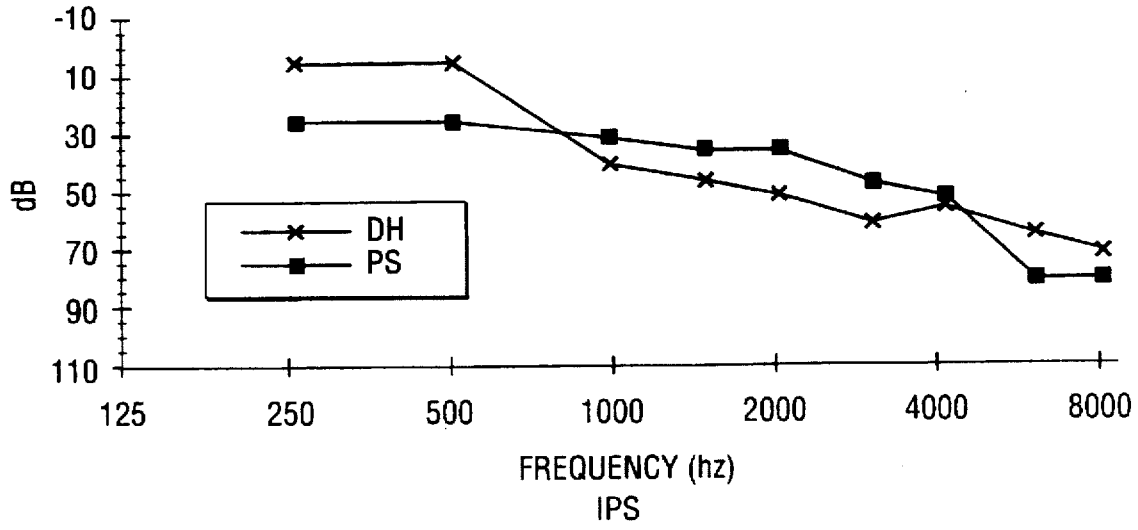
FIG. 5 is an audiogram showing the frequency response of each of the two most completely tested subjects.

Two subjects, identified as DH and PS, had the most complete testing. FIGS. 3 and 4 include graphic representations of the two subjects' test results (percent correct at the three dB levels for each type of signal processing). A male voice, M1, was used. FIG. 5 shows an audiogram (dB versus frequency in Hz) for the two subjects.

Figure 2:
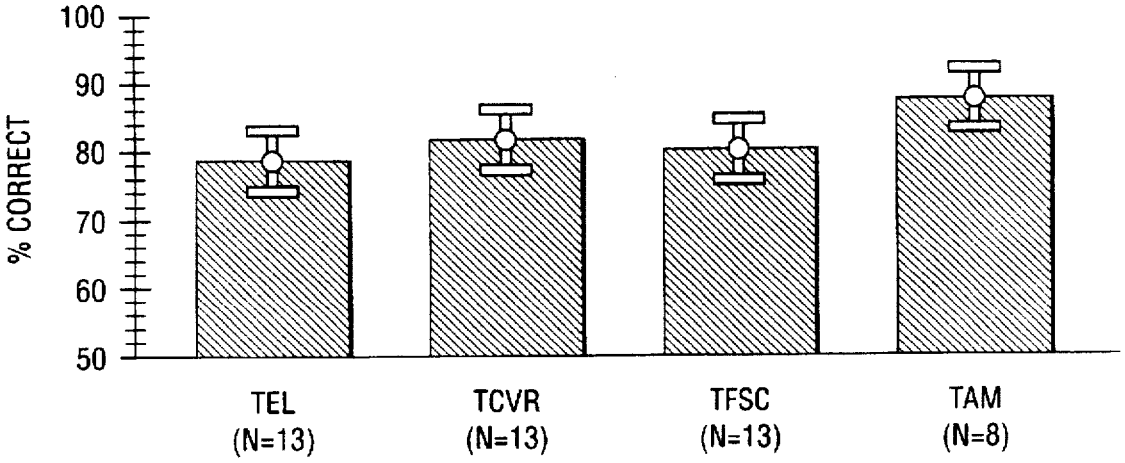
FIG. 2 is a graph showing averaged scores of subjects listening to unenhanced and enhanced speech.

The data presented in FIGS. 2 through 4 indicate that the adaptive methods improved the speech intelligibility for most subjects, often outperforming the frequency shaping method. This implies that the prescription fitting of algorithms may not be essential for subjects with at least certain types of hearing impairments.

While the best mode for carrying out the invention has been described in detail, those familiar with the art to which this invention relates will recognize various alternative designs and embodiments for practicing the invention as defined by the following claims.

What is claimed is:

1. A method for processing a telephone speech signal, comprising the steps of:

a) transforming a digital representation of the speech signal into an auditory spectrum;

b) identifying regions within the auditory spectrum of strong first and second formants;

c) enhancing identified second formants relative to their respective first formants;

d) identifying consonant regions within the auditory spectrum;

e) amplifying the identified consonant regions, the amplification of the consonant regions increasing the consonant/vowel intensity ratio, the enhancement of the second formants and the amplification of the consonant regions producing a modified auditory spectrum;

f) mapping the modified auditory spectrum to a Fourier spectrum;

g) converting the Fourier spectrum to the time domain using an inverse fast-Fourier transform; and h) normalizing the converted Fourier spectrum to provide a digital representation of a processed speech signal having more energy in regions of the second formants and the consonants.

2. The method of claim 1, wherein the digital representation of the speech signal of step a) is transformed into the auditory spectrum by passing it through a bank of filters distributed according to the Bark frequency scale.

3. The method of claim 2, wherein the regions of first and second formants of step b) are identified by peak picking.

4. The method of claim 3, wherein the second formants of step c) are enhanced relative to their respective first formants by attenuating the respective first formants.

5. The method of claim 4, wherein the respective first formants are attenuated by passing them through a filter having a 10 to 14 dB/octave rolloff.

6. The method of claim 2, wherein the consonant regions of step d) are identified as having an energy level below a threshold associated with vowels and above a threshold associated with silent regions.

7. The method of claim 2, wherein mapping the modified auditory spectrum to a Fourier spectrum is effected by mapping from the Bark scale to a linear frequency scale.

8. The method of claim 1, further including, after step h), the step of converting the digital representation of a processed speech signal into an analog signal for communication to the telephone receiver of the hearing impaired user.

9. A system for processing a telephone speech signal, the system comprising:

transforming means for transforming a digital representation of the speech signal into an auditory spectrum;

formant identification means for identifying regions within the auditory spectrum of strong first and second formants;

enhancement means for enhancing identified second formants relative to their respective first formants;

consonant identification means for identifying consonant regions within the auditory spectrum;

amplification means for amplifying the identified consonant regions to increase the consonant/vowel intensity ratio, the enhancement of the second formants and the amplification of the consonant regions producing a modified auditory spectrum;

mapping means for mapping the modified auditory spectrum to a Fourier spectrum;

converting means for converting the Fourier spectrum to the time domain using an inverse fast-Fourier transform; and normalization means for normalizing the converted Fourier spectrum to provide a digital representation of a processed speech signal.

10. The system of claim 9, wherein the transforming means include a bank of filters distributed according to the Bark frequency scale.

11. The system of claim 10, wherein the enhancement means include a filter, having a 12 dB/octave rolloff, through which respective first formants are passed.

12. The system of claim 11, wherein the mapping means include means for mapping from the Bark scale to a linear frequency scale.

13. The system of claim 9, further including conversion means for converting a digital to an analog signal to communicate to the telephone receiver of the hearing impaired user.

* * * * *